United States Patent [19]

Cocciadiferro et al.

[11] Patent Number: 5,009,059

[45] Date of Patent: Apr. 23, 1991

[54] METHOD AND APPARATUS FOR PROTECTING THE FINISHED SURFACES OF SANITARY FIXTURES

[75] Inventors: Michael J. Cocciadiferro, West New York; Robert J. De Serio, Bloomfield, both of N.J.

[73] Assignee: American Standard Inc., New York, N.Y.

[21] Appl. No.: 570,747

[22] Filed: Aug. 22, 1990

Related U.S. Application Data

[62] Division of Ser. No. 329,722, Mar. 14, 1989, Pat. No. 4,970,733.

[51] Int. Cl.[5] ..... B65B 11/00; B65B 23/00

[52] U.S. Cl. ..... 53/472; 53/462

[58] Field of Search ..... 53/472, 462; 4/580, 4/581, 582, 583, DIG. 18

[56] References Cited

U.S. PATENT DOCUMENTS

| | | | |
|---|---|---|---|
| 1,081,987 | 12/1923 | Price | 4/580 |
| 1,571,335 | 2/1926 | Jarvis | 4/580 |
| 1,579,530 | 4/1926 | Heller et al. | 4/580 |
| 1,665,215 | 4/1928 | Mittendorf | 4/580 |
| 1,686,560 | 10/1928 | Howlett | 4/580 |
| 2,575,236 | 11/1951 | Slawson | 4/580 |
| 3,045,254 | 7/1962 | Cook et al. | 4/580 |
| 3,460,167 | 8/1969 | Benjamin | 4/580 |

*Primary Examiner*—Henry J. Recla
*Assistant Examiner*—David J. Walczak
*Attorney, Agent, or Firm*—Blum Kaplan

[57] ABSTRACT

The present invention concerns a method of protecting the finished surfaces of a sanitary fixture against damage during installation and construction at an installation site. In general, the method involves installing a removable protective covering over substantially all the finished surfaces of a sanitary fixture, prior to delivering the sanitary fixture to the installation site. Thereafter, the sanitary fixture and the installed protective covering, as a single unit, are delivered to the installation site. After, completion of installation and construction, and removal of the protective covering from the finished surfaces of the sanitary fixture, the finished surfaces thereof are free from damage.

Another aspect of the present invention is to provide a protective covering having a geometry which generally conforms to the geometry of the finished surface of the sanitary fixture and has a construction sufficient to provide cushioning against and absorb impact of objects coming into immediate contact with any portion of the finished surface. In general, the surface protector comprises a fist protector portion and a second protector portion, each of which is formed from a plurality of planar portions which serve to protect designated portions of a sanitary fixture, but which when assembled together, provide complete protection to all the surface of the sanitary fixture. A further aspect of the present invention is to provide a method of manufacturing a reversible surface protector assembly of the present invention using computer-aided design and control techniques.

3 Claims, 6 Drawing Sheets

FIG. 1A
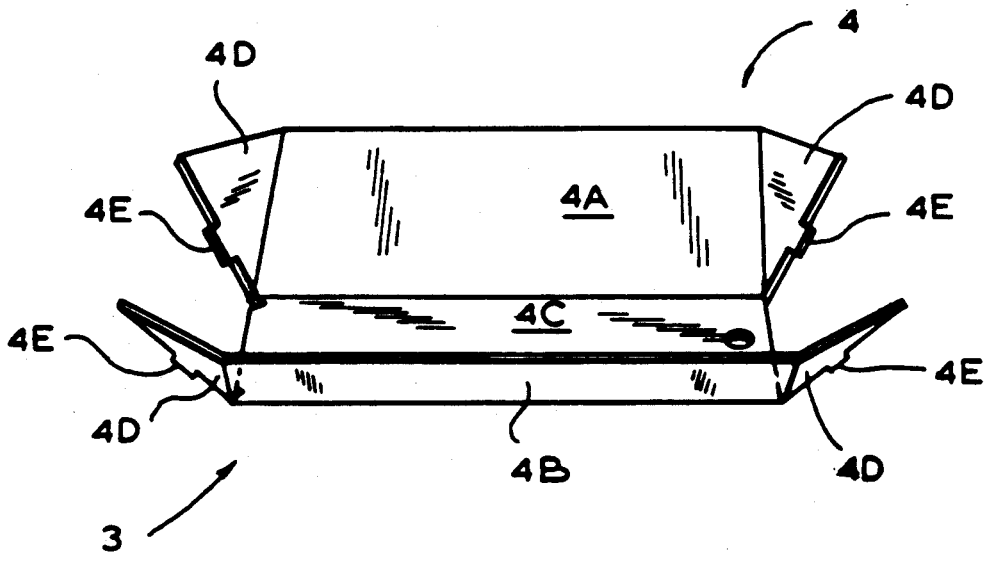
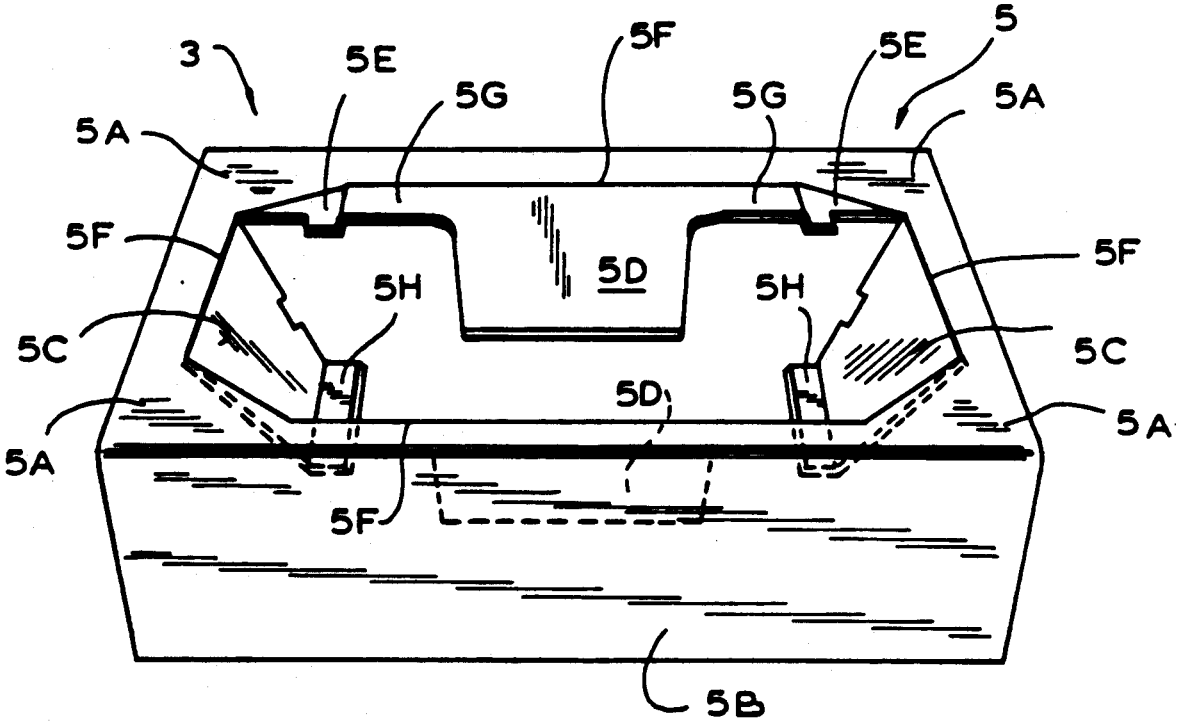
FIG. 1B

FIG. 2A
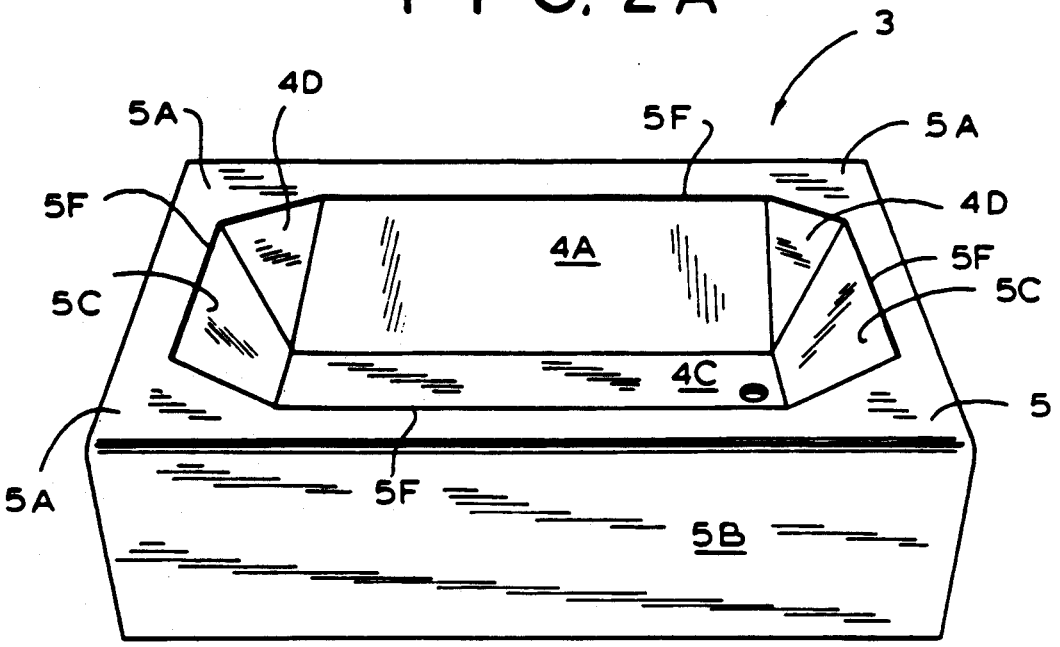
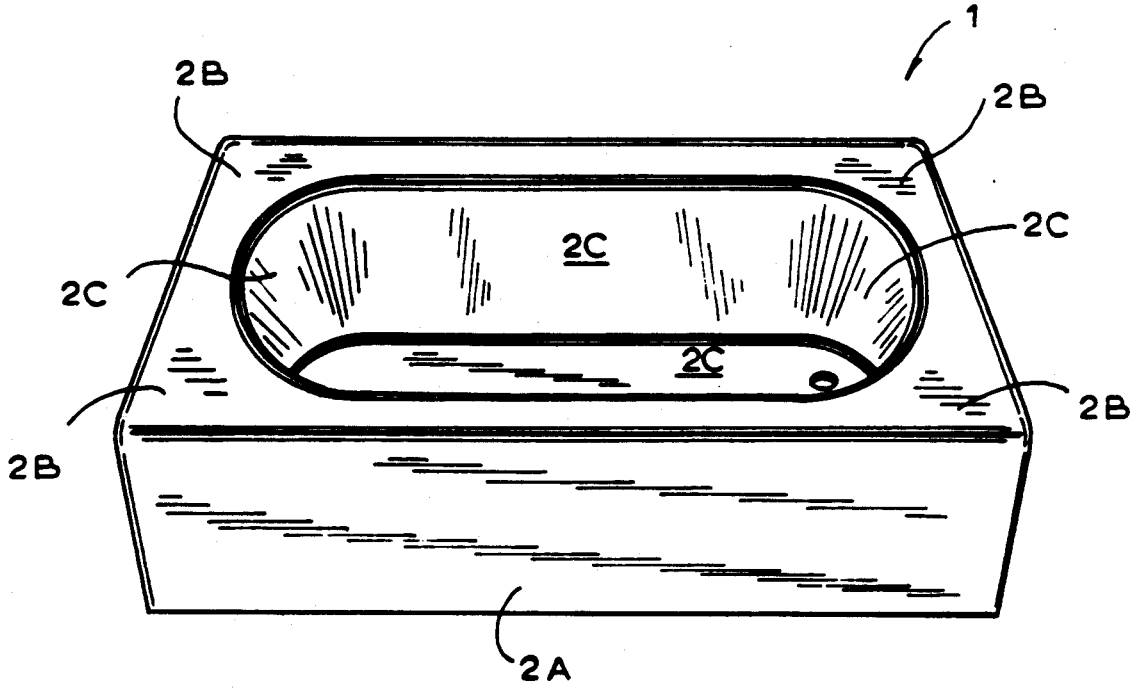
FIG. 2B

FIG. 3
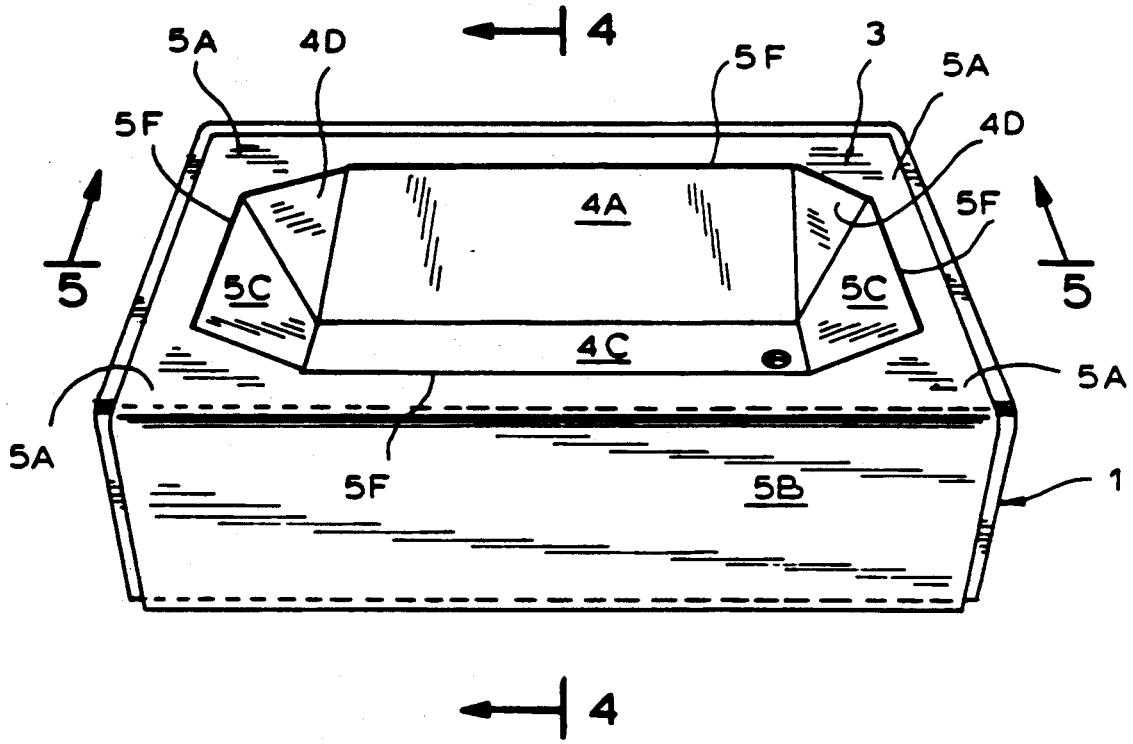
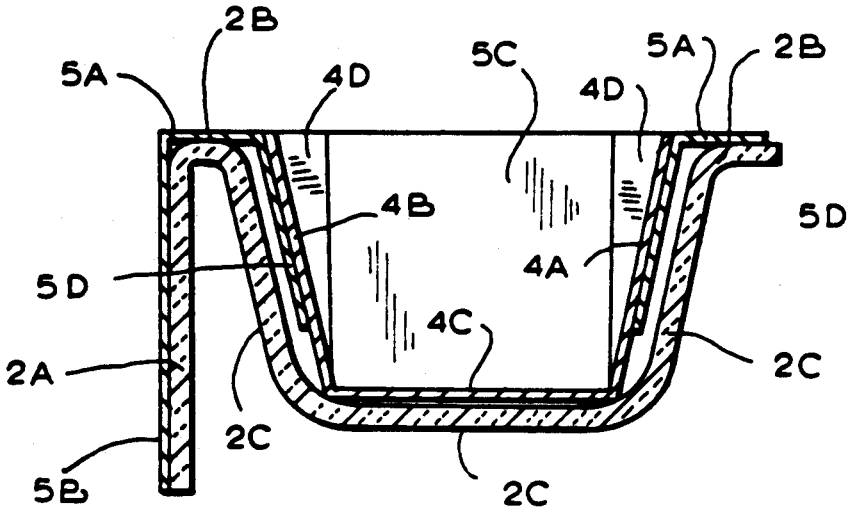
FIG. 4

METHOD AND APPARATUS FOR PROTECTING THE FINISHED SURFACES OF SANITARY FIXTURES

This is a division of application Ser. No. 07/329,722, filed on Mar. 14, 1989, now U.S. Pat. No. 4,970,733.

FIELD OF THE INVENTION

The present invention relates to methods and apparatus for protecting the finished surfaces of sanitary fixtures, and more particularly, to a method and apparatus of protecting the finished surfaces (e.g. ceramic or enamel surfaces) of sanitary fixtures, from damage sustained during installation, and also during construction of the building into which the sanitary fixture is installed.

BACKGROUND OF THE INVENTION

Protective coverings for placement over the finished surfaces of sanitary fixtures such as bath tubs, lavatories, sinks, and miscellaneous sanitary fixtures, are well known. The primary purpose of such protective coverings is to protect and preserve the very costly and highly finished surface of the sanitary fixtures (i) during installation thereof, (ii) during construction of the building, and/or (iii) during remodeling of the bathroom or restroom, into which the sanitary fixtures are installed.

Such protective measures are very important for several reasons. For one, regardless of how careful workmen in the building trade are, while working around the sanitary fixture, it is inevitable that during the construction of the room after the sanitary fixture has been set in place, all kinds of material, tools, sand, tile, and the like are thrown onto the sanitary fixture (e.g., bathtub) and workmen with their heavy work shoes stand in the sanitary fixture thereby scratching the finished surface and in many instances chipping the enamel. Clearly, a sanitary fixture with a chipped, scratched, marred, nicked, or otherwise damaged finished surface is worth significantly less to its purchaser, and in most instances, the consequences of such damage to the finished surface is that the owner will not accept the sanitary fixture. This often necessitates that the plumber or other contractor (i) repair the finished surface using expensive surface refinishing processes which never produce a surface as good as the original surface, and in worse cases, (ii) remove the damaged sanitary fixture and replace it with a new one, resulting in significant loss to the contractor held responsible. In addition, as a result of the damaged sanitary fixture, disputes often arise as to who damaged the fixture, ending often without satisfactory results.

Hitherto, a variety of prior art protective covers for bathtubs have been proposed, and are generally described in U.S. Pat. Nos. 1,571,335; 2,575,236; and 3,460,167.

However, prior art protective covers have failed seriously from protecting the finished surfaces from damage for a variety of reasons, and the universally accepted prior art method of protecting the finished surface of a sanitary fixture, likewise suffers from numerous shortcomings and drawbacks.

In particular, since prior art methods of bathtub surface finish protection involve shipping bathtub surface protectors separately from the tub, it is not uncommon for the tub surface protector to arrive on the installation or construction site well after the tub has been placed in position, thereby leaving the tub surface susceptible to damage until the tub surface protector is eventually installed.

It has also been characteristic of prior art methods to require placing a protective cover within a sanitary fixture (e.g. a bathtub) only after the bathtub has been set in position and before the tile has been placed or the painting finished.

Also, prior to placement of the prior art protective covers upon the finished surfaces of a bathtub, it is common for debris including sand and other fine particles, to find their way between the finished surface and the prior art bath tub surface protector. In such situations, relative movement between the finished surface and the bathtub surface protector, due for example, to the movement of a workman's feet standing in the bathtub, results in "sandpaper action" on the finished tub surface, thereby causing severe damage to its finish.

While the shape and materials of such prior art bathtub protective covers differ in a variety of respects, in general, nearly all of these protective covers typically have a common shape which is intended to fit all sizes and geometries of a particular sanitary fixture. However, since inconsistencies in fit occur, such protective covers poorly fit almost all sanitary fixtures, thus leaving the sanitary fixture susceptible to damage as discussed hereinabove.

The prior art surface protectors intended to fit all size bathtubs, suffer from other shortcomings and drawbacks as well.

In particular, such prior art surface protectors have surfaces which obviate conforming generally to the surface geometry of the finished surfaces of the sanitary fixture, and instead, provide a "box-like" compartment or empty space about them, which are structurally weak and cannot be stood upon by plumbers, electricians or other workmen, and thus require conspicuous markings such as "DO NOT STEP HERE" and the like.

Also, since installation of some bathtubs occurs prior to the completion of the walls and roof of the building, rain often fills up a portion of the bathtub into which prior art tub surface protectors have been installed, thus ruining the material from which the protector is made and/or loosening the adhesive material used to hold the tub protector in place on the finished tub surface. Thus, when workmen come on the site for installation and construction, the water-saturated bathtub surface protector is incapable of providing necessary finished surface protection.

Prior art bathtub finished surface protectors suffer from further shortcomings and drawbacks. For example, on the one hand, since some prior art bathtub surface protectors are made from ordinary cardboard, rain and other natural elements upon the surface protector tend to break down or otherwise deteriorate the material of the surface protector prior to and/or while workmen are standing on and working over such tub surface protectors. The natural consequence of this, is of course, that prior art bathtub surface protectors constructed in this manner afford little, if any, protection to the finished surface of the bathtub.

On the other hand, prior art surface protectors made from plastic films and other materials are not biodegradable and thus are not easily disposed of, and therefore can contribute to environmental and safety problems.

Accordingly, there is a great need in the sanitary fixture art and construction industries, for a new method and apparatus for effectively protecting the finished surfaces of sanitary fixtures, while overcoming the shortcomings and drawbacks associated with prior art methods and apparatus.

Therefore, it is a primary object of the present invention to provide a novel method of protecting the finished surfaces of sanitary fixtures, during installation and building construction.

It is another object of the present invention to provide apparatus for protecting all of the finished surfaces of a sanitary fixture, while providing improved cushioning and impact absorption.

A further object of the present invention is to provide such apparatus in the form of a bathtub protector having a geometry which conforms generally with the surface geometry of the finished surface to be protected during installation and construction.

A further object of the present invention is to provide a bathtub surface protector which is water-resistant.

It is a further object of the present invention to provide a method of manufacturing a surface protector for protecting the finished surface of a sanitary fixture.

Yet an even further object of the present invention is to provide a finished surface protector which is "reversible" for protecting both "left-handed" and "right-handed" bathtubs.

Other and further objects of the present invention will be explained hereinafter, and will be more particularly delineated in the appended claims, and other objects of the present invention will hereinafter be apparent to one with ordinary skill in the art to which the present invention pertains.

SUMMARY OF THE INVENTION

According to one aspect of the present invention, a method is provided for protecting the finished surfaces of a sanitary fixture against damage sustainable during installation of the sanitary fixture and during construction thereabout at the installation site.

In general, the method comprises installing a removable protective covering over substantially all the finished surfaces of the sanitary fixture, prior to delivering the sanitary fixture to the installation site. In general, the protective covering has a geometry which generally conforms to the surface geometry of the finished surface of the sanitary fixture, and also has a construction sufficient to provide cushion against and absorb impact of objects coming into mediated contact with a portion of the finished surface. Thereafter, the sanitary fixture and the installed protective covering, are delivered to the installation site at which the sanitary fixture is to be installed.

As a result of this method of the present invention, the sanitary fixture can be installed at the installation site with the surface protector covering and protecting the finished surfaces of the sanitary fixture against damage sustainable during installation of the sanitary fixture by workmen such as plumbers, carpenters, and masons, and also during construction occurring thereabout. Thereafter, the protective covering can be simply removed from the installed sanitary fixture so as to provide the finished surfaces of the sanitary fixture clean and undamaged after the completion of installation and construction.

In the preferred embodiment, the sanitary fixture with the protective covering installed thereon, is first packed into a shipping carton prior to delivery of the sanitary fixture and installed protective covering, to the installation site. Then, the sanitary fixture, installed protective covering, and shipping carton are delivered (i.e. shipped) as a single shipping unit to the installation site. At the installation site, the sanitary fixture with the surface protector are unpacked as a single unit from the shipping carton, by removing, the sanitary fixture with the protective covering remaining installed thereon.

Another aspect of the present invention concerns a surface protector assembly for placement over the finished surface of a sanitary fixture having a finished deck portion, a finished apron portion, and a finished sump portion. When placed over the finished surfaces of the sanitary fixture, the surface protector assembly protects the finished surfaces against damage sustainable during installation of the sanitary fixture and construction thereabout at an installation site.

In general, the surface protector comprises a first surface protector and a second surface protector which when assembled provides the surface protector assembly of the present invention. In particular, the first surface protector is for placement over the deck portion and apron portion of the finished surfaces The first surface protector has a planar deck and apron portions which are flexibly connected together and installable substantially against and conforming to the finished surfaces of the deck and apron portions, respectively. The planar deck portion has a sump-defining perimeter formed therein, which defines the sump portion of the sanitary fixture, such as the reservoir portion of a bathtub. On the other hand, the second surface protector is for placement over the sump portion of the finished surface. The second surface portion has a plurality of planar sump surface-covering portions which are flexibly connected together, and are installable substantially against and conforming to a substantial portion of the finished surfaces of the sump portion.

In the preferred embodiment, the planar deck portion of the first surface protector further includes a plurality of planar sump-covering portions which (i) are flexibly connected to the planar deck portion at the sump-defining perimeter and (ii) partially cover the finished surface of the sump portion of the sanitary fixture. At least two or more portions of the second surface protector overlap the sump-covering planar portions of the planar deck portion, i.e. at overlapping regions thereof, and are bondable at these overlapping regions in order to form the surface protector assembly of the present invention.

In another embodiment, the planar sump-covering portions extending from the planar deck portion of the first surface protector, comprise four planar sump-covering portions, each having a geometry to cover one of the four quadrilaterally disposed portions of the finished surface of the sump portion. Typically, each planar sump-covering portion comprises a polygonal-shaped panel.

In the preferred embodiment, the sanitary fixture is a bathtub having a deck portion, an apron portion, and a sump portion including a drain, a bottom surface, and first and second side and end wall surfaces. Each of the portions has a respective finished surface. The planar deck and apron portions of the first surface protector are installable substantially against and conforming to the finished surfaces of the deck and apron portions, respectively, and the polygonal-shaped planar sump-covering portions of the planar deck portion include polygonal-shaped planar portions for covering the first and second end walls of the sump portion of the bathtub. Also provided by the planar deck portion are polygonal-shaped planar portions for covering the first and second side walls of the sump portion of the bathtub.

Another aspect of the present invention is to provide a method of manufacturing the surface protector assembly of the present invention. In general, the method of manufacture involves forming a 3-D polygon-mesh model of the finished surfaces of the sanitary fixture to be protected. On the basis of the 3-D polygon-mesh model of the finished surfaces, the geometry and dimensions of the first and second surface protectors are determined. Thereafter, on the basis of the geometry and dimensions determined above, a 2-D design pattern for each of the first and second surface protectors, is formed. Then using the design patterns formed as described above, a 2-D pattern of the first and second surface protector is formed in two dimensions from impact-absorbing planar construction material. Each 2-D pattern has scored panels which are foldable at the scored depressions, and are configurable into three dimensional structures so as to form the first and second surface protectors.

In the preferred embodiment, the 3-D polygon-mesh model of the finished surfaces of the sanitary fixture is generated using a 3-D computer-aided design system with polygon-mesh surface-modeling capabilities. Further, in the preferred embodiment, the 2-D design patterns are formed by first generating "2-D tool paths" for controlling a CNC machine so as to perform cutting and scoring operations in the two-dimensional construction material. Thereafter, using the 2-D tool paths, the 2-D patterns are formed using a CNC machine to carry out the above-described cutting and scoring operations.

One of the principle advantages of the surface protector assembly of the present invention is that, since each of the first and the second surface protectors are formed from two-dimensional moisture resistent construction materials, the components of each surface protector assembly hereof can be shipped from the manufacturing facility as 2-D structures. This feature of the present invention minimizes the volume required to ship the components of each surface protector assembly to the sanitary fixture factory, at which preferably the surface protector assembly hereof is installed onto the finished surfaces of the sanitary fixtures, prior to delivering of the sanitary fixtures to the installation site. This feature of the present invention, in effect, reduces the costs in carrying out the method of finished-surface protection of the present invention.

As a result of the present invention, the shortcomings and drawbacks of the prior art methods and apparatus of protecting finished surfaces of sanitary fixtures, have been overcome, while gaining numerous other advantages which will become apparent hereinafter.

BRIEF DESCRIPTION OF THE DRAWINGS

For a fuller understanding of the objects of the present invention, reference is made to the following detailed description of the preferred embodiment which is to be taken in connection with the accompanying drawings, wherein:

FIG. 1A is a perspective view of the sump portion of the bathtub surface protector of the present invention;

FIG. 1B is the deck and apron protector portion of the bathtub surface protector of the present invention;

FIG. 2A is a perspective view of the sump and deck and apron protector shown in FIGS. 1A and 1B, assembled to form the bathtub surface protector assembly of the present invention;

FIG. 2B is a perspective view of a bathtub having a finished surface, over which the assembled bathtub surface protector illustrated in FIG. 2A is to be installed;

FIG. 3 is a perspective view of the surface protector assembly illustrated in FIG. 2A, fitted onto the bathtub illustrated in FIG. 2B;

FIG. 4 is a cross-sectional view of the bathtub and surface protector assembly of the present invention, taken along lines 4—4 in FIG. 3;

DETAILED DESCRIPTION OF THE PREFERRED EMBODIMENT OF THE PRESENT INVENTION

Figure 5:
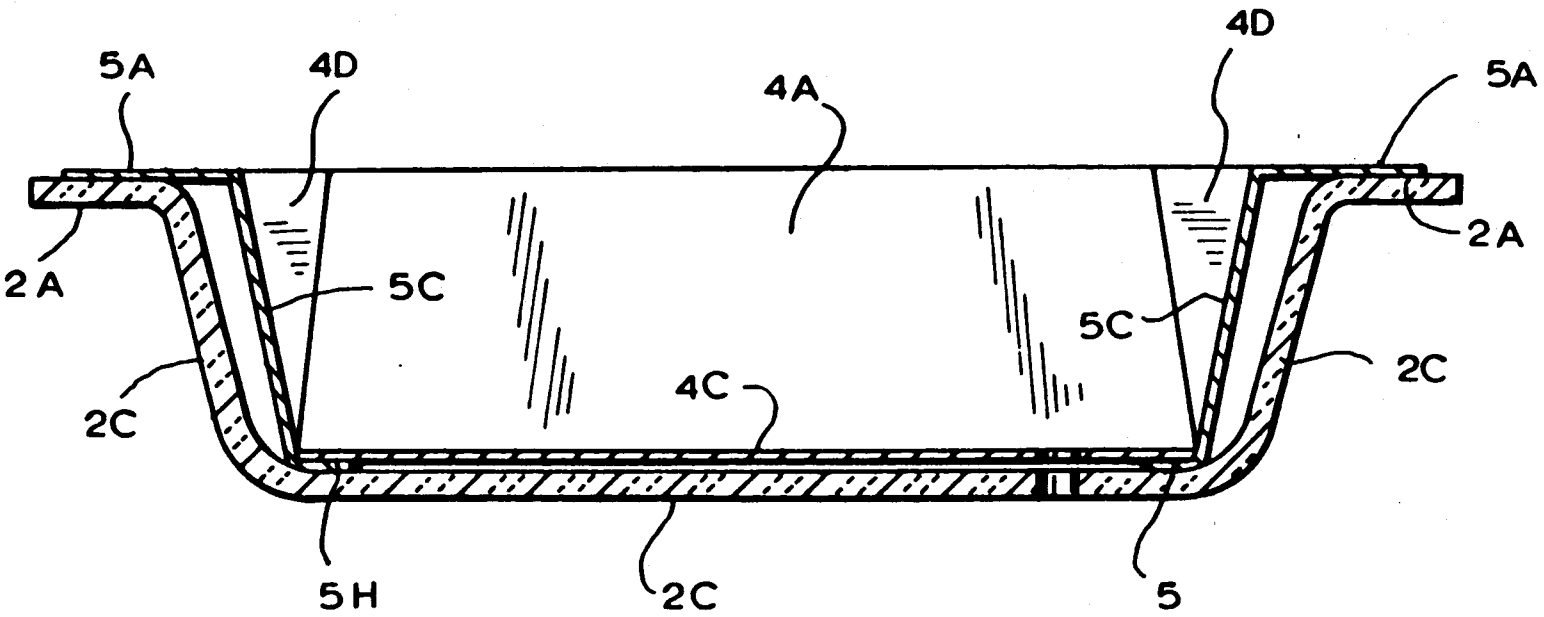
FIG. 5 is a cross-sectional view of the bathtub and bathtub surface protector assembly of the present invention, taken along line 5—5 in FIG. 3.

Referring to FIGS. 1A, 1B, 6, and 7 in particular, the bathtub surface protector assembly of the present invention, and method of manufacturing the same, will now be described. However, in connection therewith, it is important to understand that the bathtub surface protector herein described is only one embodiment of the present invention, and naturally it is understood that the surface protector hereof can be constructed and utilized in accordance with the principles of the present invention, for protecting other types of sanitary fixtures.

In general, the surface protector assembly of the present invention comprises two components (i.e. two partial surface protectors), each formed from one or more planar panels flexibly interconnected with each other, and each functioning to bear against and substantially conform to a respective portion of the finished surface of the sanitary fixture. The two partial surface protectors are configured so that when connected together by gluing or by some other appropriate fastening means, the resulting surface protector covers and protects substantially all of the finished surface area of the sanitary fixture, while providing minimum space or gaps between the planar panels and adjacent finished surface area of the sanitary fixture. In short, the surface protector of the present invention has a surface geometry which comprises a plurality of planar subsurfaces connected together so as to substantially conform to and lie closely against the two- and three-dimensional finished surfaces forming the surface geometry of a sanitary fixture, such as a bathtub.

To fully appreciate the nature and advantages provided by the present invention, it is helpful to describe the general character of sanitary fixtures, such as bathtubs and sinks, and to point out with particularity how each of the two partial surface protectors of the present invention, when assembled, function to provide full protection against scratches, chipping and the like, to all of the finished surface area of a sanitary fixture.

Sanitary fixtures, regardless of their intended uses or specific geometries, are similar from the point of view of the present invention, by the fact that each such fixture has a sump portion, a deck portion, and an apron portion, with each such portion having a finished surface. The sump portion is that recess or reservoir in the sanitary fixture into which water or other liquid collects. The deck portion is that upwardly facing portion of the fixture which has a finished surface typically planar although not necessarily and often serves to hold or provide a platform for objects such as bars of soap in the case of sinks. The apron portion, on the other hand, is the outwardly facing side surface of the sanitary fixture, often the front side disposed in the plain view of the sanitary fixture's user, and has a finished side as well.

Thus, in the case of a bathtub mounted in the corner against two orthogonally disposed bathroom walls, the apron portion of this sanitary fixture would be the two "outwardly facing" finished side wall surfaces of the bathtub, whereas the tub basin would be the sump portion, and the top outer surface would be the deck portion of such a sanitary fixture. Similarly, as illustrated in FIGS. 1A, 1B, 2A, 2B, and 3, in the case of a bathtub 1 intended for mounting within the space defined by three orthogonally disposed bathroom walls, the apron portion of such a sanitary fixture, denoted by 2A, is the front outwardly facing finished side wall of the bathtub 1, and the deck portion, denoted by 2B, is the top outwardly facing finished surface, whereas the sump portion of the bathtub is denoted by reference number 2C. Taken together, finished surfaces 2A, 2B and 2C constitute the finished surfaces of the sanitary fixture illustrated hereinafter, which are to be protected by the surface protector assembly and the method of finished surface protection of the present invention.

In the case of a bathroom sink mounted against a single bathroom wall, the apron portion of such a sanitary fixture would be the three "outwardly facing" side wall surfaces of the bathroom sink, whereas the sink basin would be the sump portion, and the top outer surfaces would be the deck portion of such a sanitary fixture.

Referring now to FIGS. 1A, 1B, 2A, 6 and 7, in particular, the surface protector assembly 3 of the present invention is shown comprising a sump liner or protector 3, and a deck and apron protector 5 for use in protecting the finished surface of a bathtub.

In the preferred embodiment, the surface protector assembly components 4 and 5 are constructed from moisture-resistant corrugated fiberboard. One of the principal advantages of using such construction material to form the surface protector assembly hereof is that such material is biodegradable and is therefore easily disposed of. Also, such material is easily creased, cut and/or foldable, and in addition to providing excellent impact adsorption and cushioning, also provides an aesthetic advantage over "plastic skin" used to form prior art surface protectors, that is, when cut, creased, and folded corrugated fiberboard construction appears stronger and more rugged than plastic coverings.

Referring to FIG. 1A, the sump protector 4 is shown comprising side wall panels 4A and 4B, a floor panel 4C, and triangular-shaped corner panels 4D which are flexibly connected to the side ends of the side wall panels 4A and 4B. At the unconnected side edges of each triangular-shaped panel 4D, a tab 4E is provided which serves to interlock with an adjacent panel provided to the sump portion 5C of the deck and apron protector 5 to be described in detail hereinbelow. Notably, the shape of the sump protector 3 is such that it substantially conforms to the surface geometry of a substantial, although not necessarily the entire sump portion 2C of the bathtub 1 in FIG. 2B.

Referring to FIG. 1B, the deck and apron protector 5 is shown comprising a planar deck portion 5A, a planar apron portion 5B flexibly connected to the planar deck portion 5A, and a plurality of planar sump-covering portions 5C, 5D, 5E and 5G. The planar deck portion 5A of deck and apron protector 5, has a sump-defining perimeter 5F formed therein which defines the outer boundaries of the sump or reservoir region of the bathtub 1 in FIG. 2B.

In the preferred embodiment, the plurality of planar sump-covering portions 5C, 5D, 5E and 5G are generally polygonal in nature and are flexibly connected to the planar deck portion 5A at the sump-defining perimeter 5F as illustrated in FIG. 1B in particular. In the embodiment of FIG. 1B, the planar sump-covering portions comprise two rectangular-shaped opposing planar panels 5C for covering the end wall regions of the bathtub sump, and two rectangular-shaped opposing planar panels 5D for covering the side wall regions of the bathtub sump. The rectangular-shaped planar portions 5C at the end wall regions of the bathtub sump, each has an end tab panel 5H to which the sump protector 4 can be glued as will be described in detail hereinafter. Also, as illustrated in FIG. 1B, at each left and right side wall region of the bathtub sump, rectangular wing panels 5G are provided, in addition to triangular planar portions 5E at each corner of the sump-defining perimeter 5F. These panels 5E, like wing panels 5G, also provided surfaces on the deck and apron protector 5, to which the sump protector 4 can be connected by gluing for example, upon assembly, as will be described in detail hereinafter .

Thus, all twelve of the polygonal-shaped panel portions 5C, 5D, 5E and 5G are flexibly connected to the planar deck portion 5A at the sump-defining perimeter 5E, and when these panel portions are positioned to lie in a single plane, they preferably do not overlap, for if they do not overlap, then the entire deck and apron protector 5 hereof can be fabricated from a single sheet of moisture-resistant corrugated fiberboard, as will be described hereinafter.

The exact number and geometry of the planar sump-covering portions, depend on the surface geometry of the finished sump surface of a particular bathtub to be protected. Naturally, some bathtubs have sump portions with corners that gradually curve, and other types of bathtubs have sump portions with corners that sharply or abruptly curve almost approximating 90° turns, although these models presently appear to be less popular. However, regardless of the type of surface geometry of a particular bathtub sump portion, the sump surface protector 4 and preferably the deck and apron surface protector 5 as well, will provide a plurality of planar sump-covering portions selected from a variety of planar geometries, in order to approximate the actual surface geometry of the sump portion and thereby substantially conform to and about substantially against the finished surfaces of the sanitary fixture. This particular feature of the present invention is illustrated in FIGS. 4 and 5, which show cross-sectional views of the planar protectors 4 and 5 assembled together and installed within the bathtub 1 of FIG. 2A.

It is appropriate at this juncture to describe the manner in which the sump protector 4 and deck and apron protector 5 are fabricated in accordance with the present invention.

Figure 6:
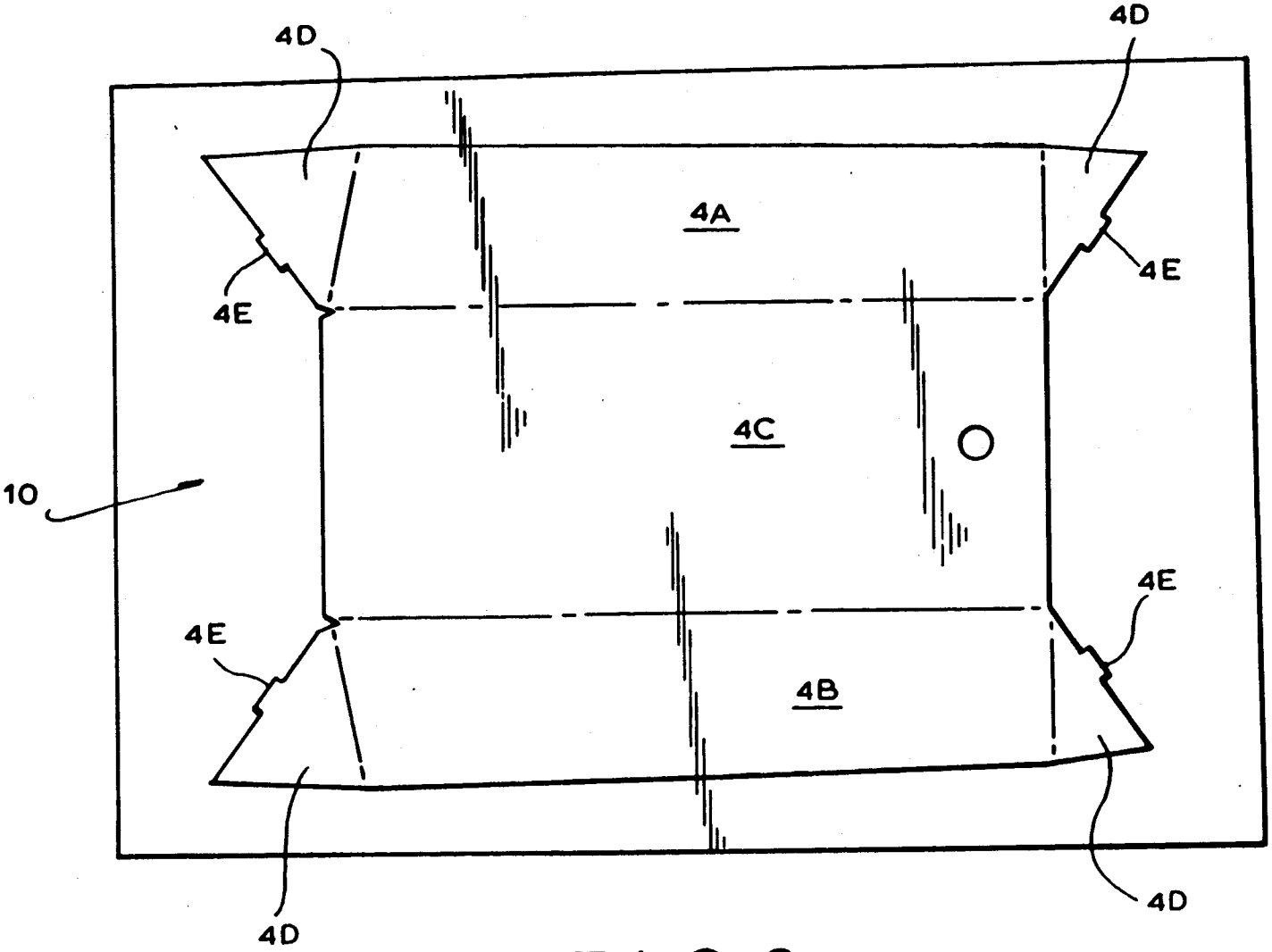
FIG. 6 is a plan view of a design pattern to be formed from a single planar sheet of material, and subsequently folded at appropriate locations so as to form the sump portion of the bathtub surface protector hereof, illustrated in FIG. 1A in particular.

To form the sump protector 4, a design pattern 10 as illustrated in FIG. 6, is prepared as a two-dimensional representation. The design pattern 10 in essence provides an accurately scaled model of the sump protector 4 disposed in two dimensions, including the correct positioning and dimensions of each planar panel thereof. The solid lines in the design pattern represent cutting operations to be carried out upon a sheet of fiberboard, whereas dotted or broken lines indicated where scoring (e.g. impressing) and folding operations are to be carried out.

Figure 7:
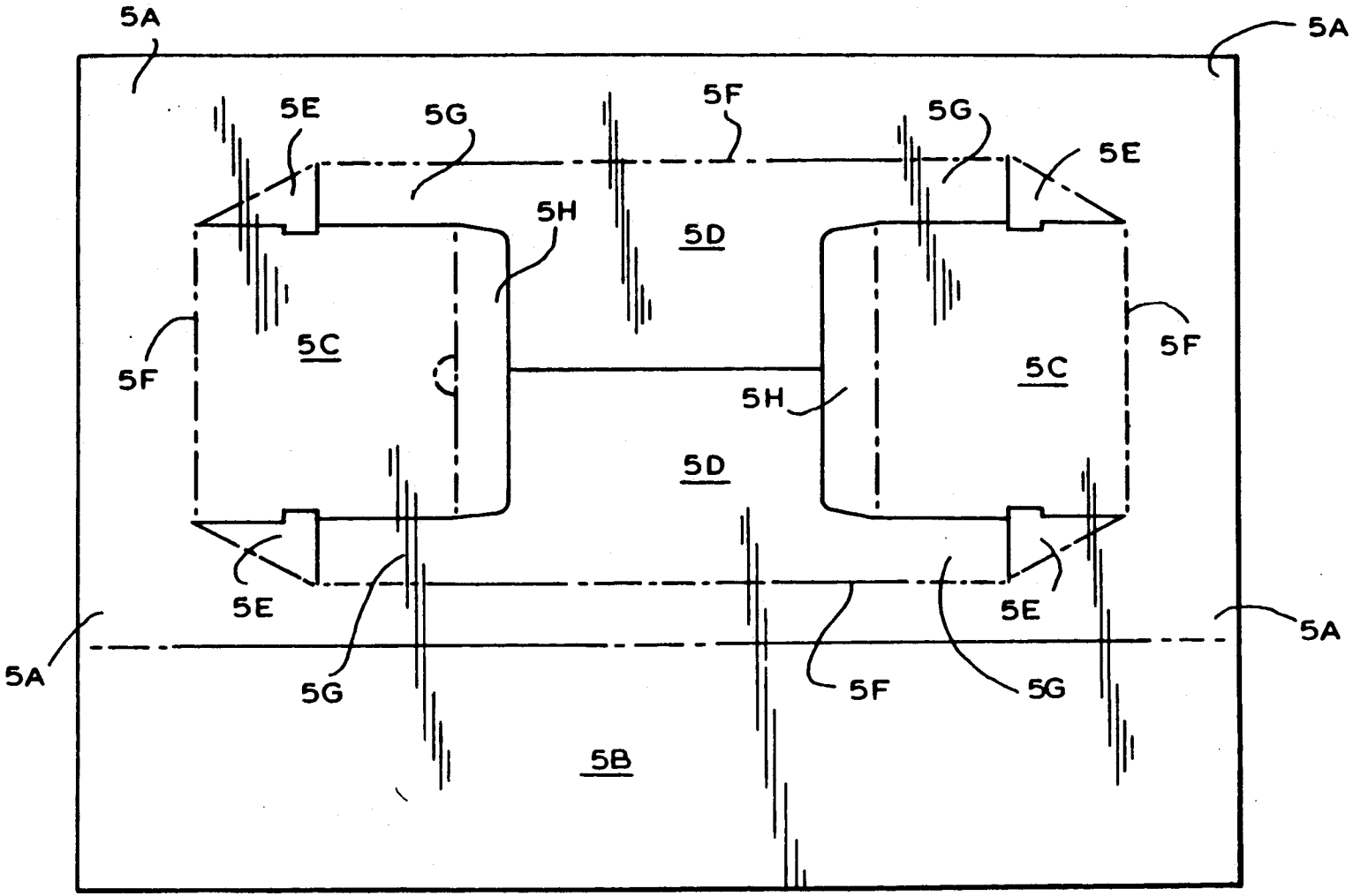
FIG. 7 is a plan view of a design pattern to be cut out from a single planar sheet of material, and subsequently folded at appropriate locations so as to form the deck and apron protector portion of the bathtub surface protector illustrated in FIGS. 1B, 2A, and 3, in particular.

Similarly, to form the deck and apron protector 5 of the present invention, a design pattern 20, as illustrated in FIG. 7, is prepared as a two-dimensional representation. The function of design pattern 20 is similar to that of design pattern 10 described above.

The method of manufacturing sump and deck/apron surface protectors according to the present invention, contemplates generating design patterns 10 and 20, by first modelling a particular sanitary fixture in three-dimensions, using a 3-D Computer-Aided-Design System. Since it is necessary to determine what set of polygonal panels would best approximate the 3-D surface geometry of the finished surface of the sanitary fixture, the use of 3-D "polygonal mesh" or "wire frame" modelling techniques (known in the computer-aided design art), to provide "polygonal mesh" or "wire frame" models of the finished bathtub surface, is most advantageous in that it can naturally facilitate the determination of what type and size of polygonal panels best approximate the 3-D surface geometry of the finished surfaces of the bathtub 1. Thereafter, whether a particular selected polygonal panel should be provided to the sump protector 4 or the deck-apron protector 5, can be determined on the basis of the 3-D polygonal mesh model.

Once the design patterns 10 and 20 have been prepared for a specific model of a particular sanitary fixture, the manufacture of pre-cut and scored "custom fit" fiberboard surface protectors 4 and 5 can be realized using computer numerically controlled (CNC) fiberboard cutting and scoring machines, in which the paths traversed by the cutting (and scoring) tools positioned above the fiberboard, is determined by the two-dimensional "tool path" corresponding to a particular design pattern, 10 and 20. In connection with the surface protector assembly 3 of the preferred embodiment, these "tool paths" can be straightforwardly determined from the design patterns 10 and 20.

Alternatively, however, the surface protectors 4 and 5 can be formed using a die-cutting process in which the dies embody the cutting lines and scoring lines illustrated, for example in FIGS. 6 and 7, and upon application of such dies to moisture-resistant double-wall corrugated fiberboard (i.e. while under pressure), patterns corresponding to 2-D representations of the surface protectors 4 and 5 are formed.

In general, the sump protector 4, and deck and apron protector 5 must form a protective surface comprising a plurality of planar facets which approximate the surface geometry of the finished surface of a particular bathtub. However, it is often advantageous from the standpoint of material resource efficiency, if the deck and apron protector 5 is formed having sump-covering planar portions, such as portions 5C, 5D, 5E and 5G. In the preferred embodiment, such material resource efficiency has been achieved by the structure of the surface protector assembly 3 of the present invention, in which the sump-covering planar portions 5C and 5D, but particularly 5C, are provided by the deck and apron protector 5, instead of by the sump protector 4. As a result of this feature, the finished surface of any sanitary fixture can be fully covered and protected by using only two partial surface protectors, each being formed from a single panel of construction material. Notably, each of these partial surface protectors comprises a plurality of polygonal planar portions, dimensioned and flexibly interconnected so as to overlap at selected sections of the planar portions and to cover the entire finished surface of the bathtub 1, thereby forming a surface protector assembly which substantially conforms to the surface geometry of substantially all of the finished surface area of the bathtub 1.

Notably, the concept of "left-handed" and "right-handed" bathtubs is fundamental in the sanitary fixture art, and the classification thereof is well known, in the case of bathtubs, to depend on the relative placement of the finished apron surface 2-D of a particular bathtub. Thus, the geometry of a surface protector assembly would typically have to vary in configuration for left-handed and for right-handed bathtubs. However, with the bathtub surface protector assembly of the present invention and the method of manufacturing the same, it is possible to use the basic 2-D cardboard patterns formed from the designed patterns 10 and 20, so as to provide a surface protector assembly for both left-handed and right-handed bathtub designs. This is because the 2-D cardboard patterns from which the surface protectors 4 and 5 are formed as described above, have very significant properties. In particular, while the design pattern 20 provides the cutting, scoring and folding operations corresponding to the manufacture of a "right-handed" bathtub, the "mirror-image" of design pattern 20, shown in FIG. 5, provides the cutting, scoring and folding operations corresponding to the manufacture of a "left-handed" surface protector.

Preferably, to modify the "right-handed" deck and apron protector 5 into a "left-handed" deck and apron protector, the 2-D precut and scored, cardboard pattern produced from design pattern 20, is configured in a reverse fashion. Specifically, by bending and folding back apron panel 5B in the opposite (i.e. reverse) direction, and by bending and folding back patterns 5C, 5D and 5E in the opposite (i.e. reverse) direction, a left-handed deck and apron surface protector is formed. By such an assembly modification, a left-handed surface protector assembly for bathtubs can be formed from the "reversible" apron and deck protector 5 and sump protector 4. As used hereinafter in the claims, such a surface protector assembly is said to be "reversible". Also, the concept of "reversibility" with regard to surface protector assemblies, shall imply that such surface protector assemblies are suitable for protecting both left-handed and right-handed sanitary fixtures, such as left-handed and right-handed bathtubs, in particular.

After having manufactured the pre-cut, and scored "custom fit" sump protector 4 and deck and apron protector 5, the two surface protectors are now ready for assembly in a manner described below, in order to form the surface protector assembly 3 of the present invention.

Referring now to FIGS. 1A, 1B, 2A and 2B in particular, the method of protecting the finished surface of a sanitary fixture according to the principles of the present invention, will be described as follows. Prior to packing the bathtub 1 into a shipping carton, typically formed from fiberboard or wood, the "custom-fit" deck and apron protector 5 is fitted over the deck and apron portion of the bathtub. Thereafter, glue or adhesive is preferable applied as a "bead" to the sump-covering planar portions 5D, 5E, 5G and 5H, and prior to curing, the "custom-fit" sump protector 4 is fitted into the sump portion of the bathtub 1, with gentle pressure being applied to the sump protector 4 at the locations corresponding the locations where adhesive has been applied to the deck and apron protector 5. At this stage, the surface protector assembly 3 is completely assembled and in place upon and covering all of the finished surfaces of the bathtub 1, as illustrated in FIG. 3.

With the surface protector assembly installed upon the bathtub as shown in FIG. 3, the nature and character of the fit of the surface protector assembly 3 hereof and the bathtub can be observed by referring to cross-sectional views shown in FIGS. 4 and 5. In particular, FIGS. 4 and 5 illustrate the fact that the sump protector 4 and deck and apron protector 5 of the present invention, while both constituted from interconnected polygonal-shaped planar panels, closely conform to the 3-D surface geometry of the finished surfaces of the bathtub 1, to be protected. Consequently, since there are no substantial "spaces" or "cavities" formed between the surface protector assembly 3 hereof and the finished surfaces of the sanitary fixture to be protected, a workman can step upon and apply pressure to any portion of the surface protector assembly 3 without substantial risk of collapsing the surface protector assembly or causing damage to the finished surfaces of the sanitary fixture.

After the surface protector assembly 3 is applied to the bathtub as described above, the bathtub 1 and surface protector assembly 3 as a single unit, is packaged into a sanitary fixture shipping carton known in the art. Thereafter, the shipping carton containing bathtub 1 with surface protector assembly 3 installed thereon, is delivered to the installation site at which the bathtub is to be installed. At the installation site, the bathtub 1 with the installed surface protector assembly 3 intact, is unpacked from the shipping carton and thereafter installed by workmen with the surface protector assembly 3 in place on the bathtub, as it was prior to delivery. After completing the installation of the sanitary fixture and construction about the installation site, the surface protector assembly 3 hereof is removed from the finished surfaces of the bathtub. This is achieved simply by raising surface protector 3 along any spaced points of panel 5B. Illustrated in FIG. 3 , the entire sump, deck and apron surfaces of protectors 4 and 5 are easily lifted out as a single unit 3 and free from the bathtub. Thus, upon removal of the surface protector assembly 3, as described above, the finished surfaces of the bathtub are exposed clean and undamaged.

While the particular embodiments shown and described above have been proven to be useful in many applications involving the sanitary fixture arts, further modifications of the present invention herein disclosed will occur to those skilled in the art to which the present invention pertains and all such modifications are deemed to be within the scope and spirit of the present invention defined by the following claims.

What is claimed is:

1. A method of protecting the finished surfaces of a sanitary fixture against damage, said sanitary fixture having a deck portion, an apron portion and a sump portion, said method comprising the sequence of steps:

(a) prior to delivering said sanitary fixture to an installation site, installing a first removable protective covering having planar deck and apron portions flexibly connected together over said deck portion and said apron portion of said finished surfaces of said sanitary fixture, said planar deck portion having a sump-defining opening formed therein surrounded by said deck, installing a second removably protective covering having a plurality of planar sump surface-covering portions flexibly connected together through said sump-defining opening and over said sump portion of said finished surfaces, said first and second protective coverings having a geometry which generally conforms to the surface geometry of said finished surface of said sanitary fixture, and having a construction sufficient to provide cushioning against and absorb impact of objects coming into mediated contact with a portion of said finished surface; and (b) delivering said sanitary fixture and said installed first and second protective coverings to an installation site at which said sanitary fixture is to be installed so that said sanitary fixture can be installed at said installation site with said installed first and second protective coverings protecting said finished surfaces of said sanitary fixture against damage sustainable during installation and construction at said installation site, and thereafter said first and second protective coverings can be removed from said sanitary fixture so as to provide said finished surfaces of said sanitary fixture undamaged after installation and construction at said installation site.

2. The method of claim 1, wherein said sanitary fixture comprises a bathtub, and wherein step (a) further comprises, prior to delivering said bathtub to said installation site, installing said first and second protective coverings over substantially all of said finished surfaces of said bathtub, said first and second protective coverings having a geometry which generally conforms to the surface geometry of said finished surface of said bathtub, and having a construction sufficient to provide cushioning against and absorb impact of objects coming into mediated contact with a portion of said finished surface.

3. The method of claim 1, wherein before step (b) said method further comprises, packing into a shipping carton, said sanitary fixture with said removable first and second protective coverings installed on said finished surfaces thereof, and wherein step (b) further comprises, delivering to said installation site, said shipping carton with said sanitary fixture and said first and second protective coverings thereon, contained in said shipping carton, and wherein after step (b), unpacking from said shipping carton said sanitary fixture, with said first and second protective coverings installed on said sanitary fixture, so that said sanitary fixture can be installed at said installation site with said installed first and second protective coverings protecting said finished surface of said sanitary fixture against damage sustainable during installation and construction at said installation site, and thereafter said removable first and second protective coverings can be removed from said sanitary fixture so as to provide said finished surfaces of said sanitary device undamaged after installation and construction at said installation site.

* * * * *